US006238023B1

(12) United States Patent
Choi

(10) Patent No.: US 6,238,023 B1
(45) Date of Patent: May 29, 2001

(54) WINDOW TYPE AIR CONDITIONER HAVING INJECTION-MOLDED UPPER AND LOWER CASINGS

(75) Inventor: Eun-chang Choi, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/391,452

(22) Filed: Sep. 8, 1999

(30) Foreign Application Priority Data

Sep. 10, 1998 (KR) ..... 98-37259

(51) Int. Cl.[7] ..... F25D 23/00
(52) U.S. Cl. ..... 312/101; 312/213; 62/262
(58) Field of Search ..... 454/201; 62/262, 62/263, 297, 298; 220/693, 692, 682; 312/100, 101, 263, 265.5, 236, 213, 242, 257.1

(56) References Cited

U.S. PATENT DOCUMENTS 2,023,876 * 12/1935 Dubrovin ..... 62/262
2,561,592 * 7/1951 Palmer ..... 454/201
2,837,365 * 6/1958 Schlueter ..... 220/692 X
3,819,244 * 6/1974 Paulick et al. ..... 62/262 X
4,113,130 * 9/1978 Lazenby et al. ..... 220/693 X
4,607,499 * 8/1986 Bolton et al. ..... 312/101 X
5,329,784 * 7/1994 Kennedy et al. ..... 62/262

* cited by examiner

*Primary Examiner*—Janet M. Wilkens
(74) *Attorney, Agent, or Firm*—Robert E. Bushnell, Esq.

(57) ABSTRACT

An air conditioner has injection-molded upper and lower casings. The upper and lower casings have upper and lower flange sections, respectively, which are formed on both sides of the upper and lower casings, respectively. Each of the flange sections is formed in a vertical direction, and has a plane outer side. Due to the presence of the flange sections, there is no gap defined when installing the air conditioner through the window. Further, the strength of the casing is increased.

19 Claims, 7 Drawing Sheets

WINDOW TYPE AIR CONDITIONER HAVING INJECTION-MOLDED UPPER AND LOWER CASINGS

CLAIM OF PRIORITY

This application makes reference to, incorporates the same herein, and claims all benefits accruing under 35 U.S.C. § 119 from an application entitled WINDOW TYPE AIR CONDITIONER HAVING INJECTION-MOLDED UPPER AND LOWER CASINGS earlier filed in the Korean Industrial Property Office on Sep. 10 , 1998, and there duly assigned Serial No. 37259/1998.

BACKGROUND OF THE INVENTION

1. Field of the Invention

The present invention relates to an air conditioner, and more particularly, to a window type air conditioner having upper and lower casings which are formed by injection molding and are coupled with each other.

2. Description of the Prior Art

Generally, as shown in FIG. 1, an air conditioner includes a front cover 10 on which a suction grill 11 and a discharge grill (not shown) are formed, a casing 20 on which a plurality of air holes 21 are formed, and a baseplate 30 which is disposed beneath the casing 20.

As shown in FIG. 1, such a window type air conditioner is mounted through a window (G) or a wall (W). Further, in the portion of the air conditioner which is exposed outside the wall (W), i.e., outside the building, a compressor, a condenser, and a cooling fan are installed, while an evaporator and a blowing fan are installed in the portion protruding inward of the wall (W), i.e., inside the building. All the above parts are mounted on the baseplate 30, and then the casing 20 and the front cover 10 are mounted on the baseplate 30.

Meanwhile, the conventional window type air conditioner constructed as above has drawbacks as follows: Since the elements for forming the appearance of the air conditioner, i.e., the casing 20 and the baseplate 30 are made of the metallic material, which is quite heavy and expensive, the manufacturing cost for the air conditioner increases, and also, the manufacturing and delivery processes become inefficient. Further, since certain parts of the casing 20 and the baseplate 30 are exposed to the outside, the air conditioner has a problem of being easily corroded by the outside environment.

In order to solve the above problem, as shown in FIG. 2, a window type air conditioner having an injection-molded casing has been suggested. In such an air conditioner, a casing 40 is comprised of a lower casing 41 and an upper casing 42. The front portion of the casing 40 is attached to a front cover 50 having both suction and discharge grills 51 and 52 on the front side thereof. The upper and lower casings 41 and 42 have a plurality of air holes 41*a* and 42*a* on the respective sides thereof. The upper and lower casings 41 and 42 are molded of materials such as synthetic resin, or the like, by injection. In such an air conditioner, since the casing 40 is made by the injection molding, the manufacturing cost decreases, and the assembly and delivery can be performed conveniently. Further, there is no risk of having any corrosion.

The above conventional air conditioner, however, has drawbacks as follows: In order to make the injection molding easier, sides of the upper and lower casings 41 and 42 are curved, respectively. More specifically, in order to easily detach the molding from the mold, the respective sides of the upper and lower casings 41 and 42 are curved. Accordingly, when such an air conditioner having curved sides is installed through the window, as shown in FIG. 3, there are gaps 62 formed between the casing 40 and a frame 61 disposed around the window for installation of the air conditioner. Such gaps 62 result in a deteriorated cooling efficiency of the air conditioner, since the outside and inside air flow therethrough. Further, the appearance of the air conditioner is deteriorated. Accordingly, when such a conventional air conditioner is installed, the gaps 62 should be sealed with a separate sealing member.

Further, since the upper and lower casings 41 and 42 are made of materials such as synthetic resins, or the like, the upper and lower casings 41 and 42 have a much lower strength.

SUMMARY OF THE INVENTION

The present invention has been made to overcome the above problems of the prior art, and accordingly, it is an object of the present invention to provide a window type air conditioner having an injection-molded casing which is manufactured more efficiently with less cost, and does not form a gap with a window.

Another object of the present invention is to provide a window type air conditioner having a strong casing.

The above objects are accomplished by a window type air conditioner according to the present invention, including: injection-molded upper and lower casings; and upper and lower flange 5 sections formed on both sides of the upper and lower casings, respectively. The upper and lower flange sections are integrally injection-molded with the upper and lower casings. The upper and lower flange sections are formed vertically, and have plane outer sides, respectively. Due to the presence of the respective flange sections, there is no gap defined between the air conditioner and window when the air conditioner is installed through the window. Further, the strength of the respective casings is increased.

Preferably, the upper and lower flange sections have inner hollow portions therein, respectively. Accordingly, it is easier to injection-mold the upper and lower casings to have plane outer sides, respectively.

Further, it is preferable that the lower and upper casings have air intake holes and air exhaust holes, respectively, to intake and exhaust the outside air.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, the preferred embodiment of the present invention will be described in greater detail with reference to the accompanied drawings.

Figure 1:
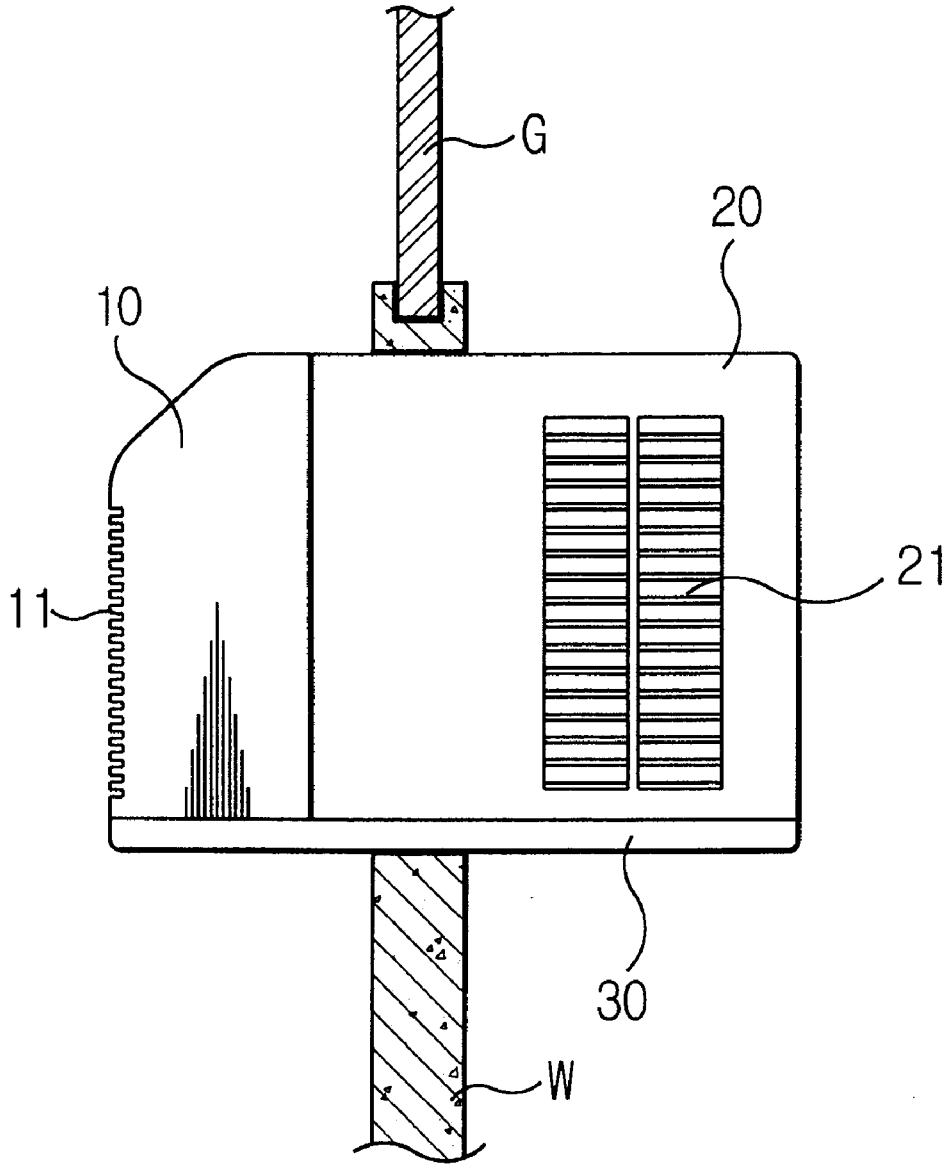
FIG. 1 (PRIOR ART)
FIG. 1 is a side-sectional view showing a conventional window type air conditioner being installed through a window.
Figure 2:
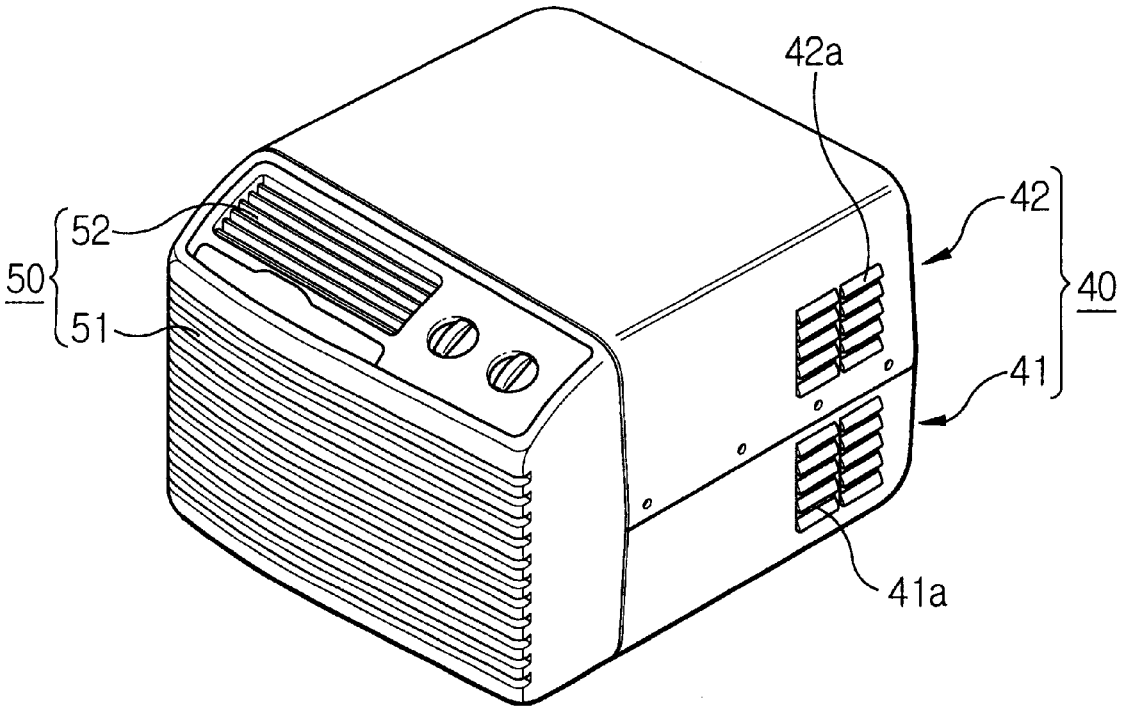
FIG.2 (PRIOR ART)
FIG. 2 is a perspective view of a conventional window type air conditioner having an injection-molded casing.
Figure 3:
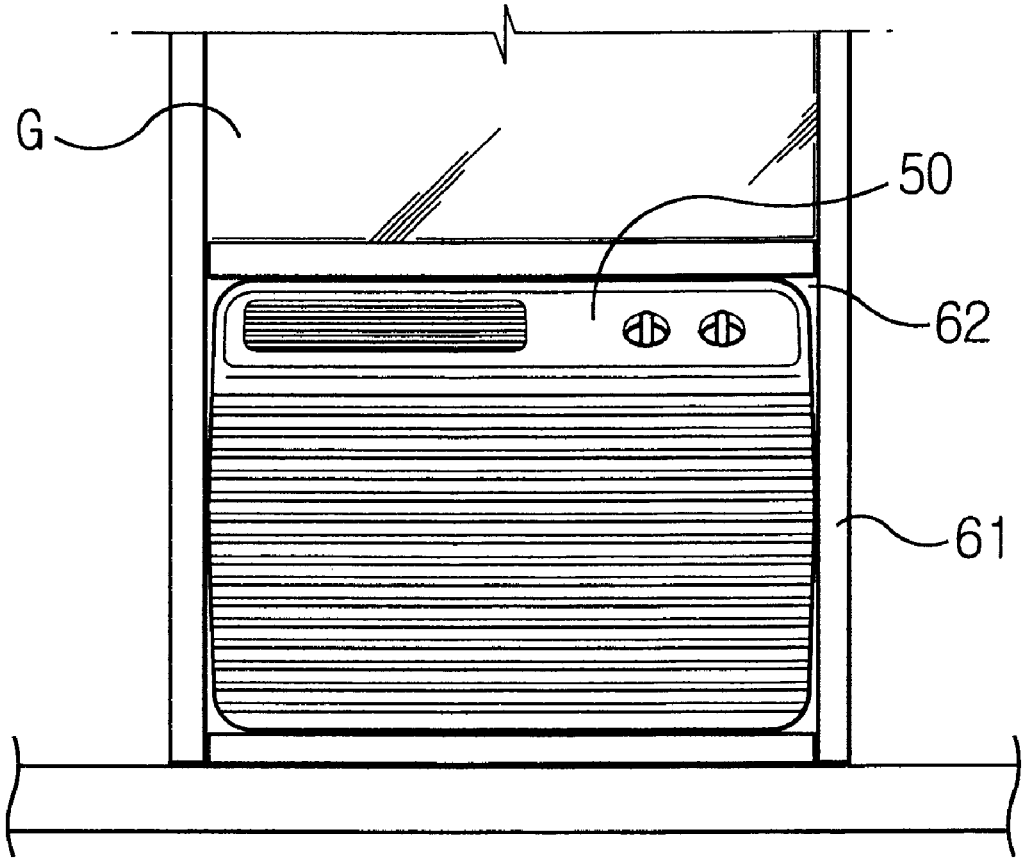
FIG.3 (PRIOR ART)
FIG. 3 is a front elevation of the air conditioner shown in FIG. 2 being installed.
Figure 4:
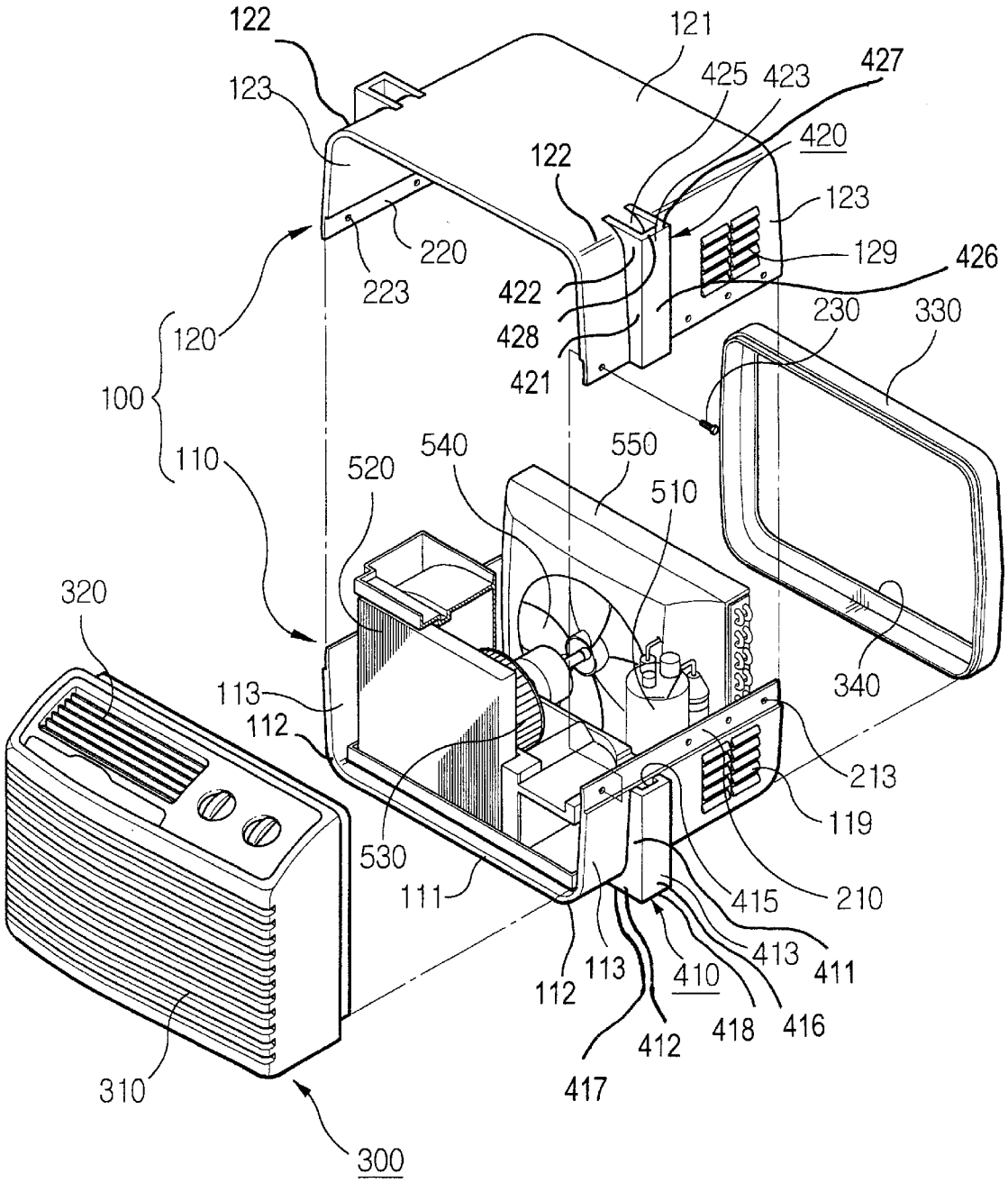
FIG. 4 is an exploded perspective view of a window type air conditioner according to the present invention.

FIG. 4 is an exploded perspective view of a window type air conditioner according to the present invention. The air conditioner according to the present invention includes a casing 100 for forming a device chamber, a front cover 300 attached to the front side of the casing 100, and a rear panel 330 attached to the rear side of the casing 100.

The casing 100 is divided into upper and lower casings 110 and 120. The lower casing 110 has a lower plate section 111, first side plate sections 113 which are upwardly extended from both sides of the lower plate section 111 and first round corners 112 formed between lower plate section 111 and one of first side plate sections 113. The upper casing 120 has an upper plate section 121, second side plate sections 123 which are downwardly extended from both sides of the upper plate section 121 and second round corners 122 formed between upper plate section 121 and one of second side plate sections 123.

In the device chamber which is defined by the upper and lower casings 120 and 110, various parts constituting the refrigerant cycle are installed. That is, a compressor 510 for compressing a refrigerant, a condenser 550 for condensing the refrigerant compressed in (or by) the compressor 510, a first fan 540 for blowing heat generated from the condenser 550 to the outside of the building, an evaporator 520 for evaporating the condensed refrigerant in the condenser 550, a second fan 530 for blowing the chilled air generated from the evaporator 520 to the inside of the building, etc. are installed in the device chamber. The above parts are fixed on the lower plate section 111 of the lower casing 110 by various fixing members (not shown). A plurality of intake holes 119 and 129 are formed on the first and second side plate sections 113 and 123.

The front cover 330 has suction and discharge grills 310 and 320. As the second fan 530 operates, the air of the room is sucked in through the suction grill 310, while the air which is chilled by the evaporator 520 is discharged back into the room through the discharge grill 320.

The rear panel 330 has an exhaust outlet 340 formed thereon. As the first fan 540 operates, the outside air is sucked in through the intake holes 119 and 129 of the casing 100, and exhausted through the exhaust outlet 340 after cooling the condenser 550.

Figure 5:
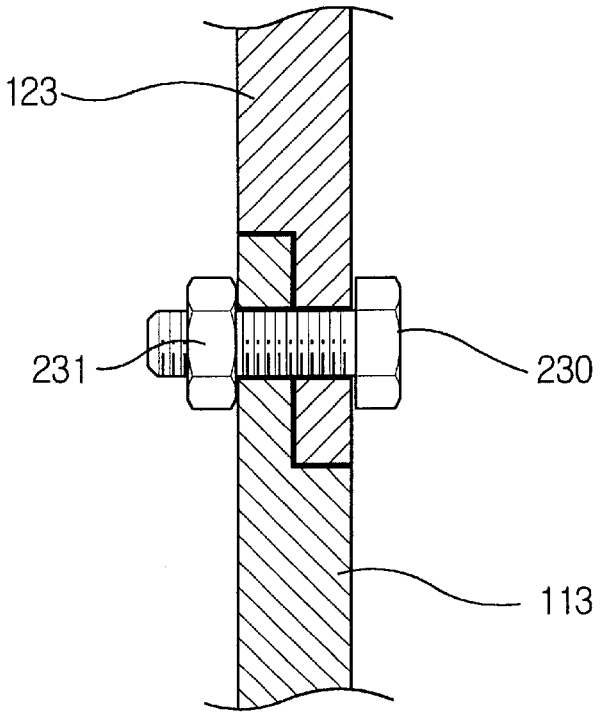
FIG. 5 is a partial side-sectional view of FIG. 4.
Figure 6:
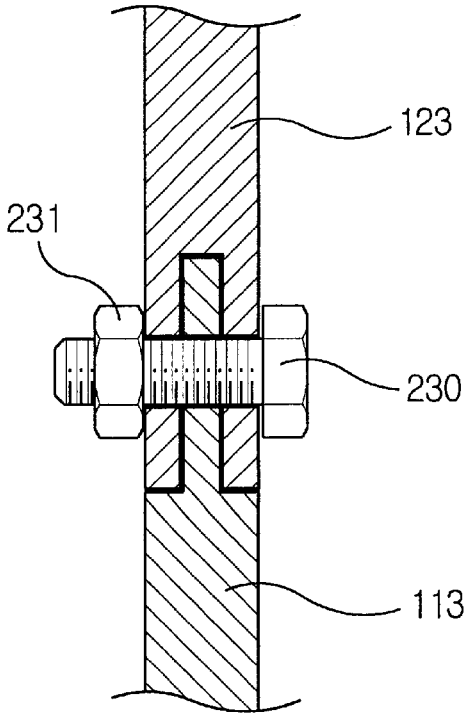
FIG. 6 is a side-sectional view showing a connecting portion shown in FIG. 5 according to another embodiment of the present invention.

The lower and upper casings 110 and 120 have fixing flange sections 210 and 220 provided at the upper and lower side portions of the first and second side plate sections 123 and 113, respectively. As shown in FIG. 5, the respective fixing flange sections 210 and 220 are formed to have the shape of stairway so as to be engaged with each other. Each of the fixing flange sections 210 and 220 has a plurality of fixing holes 213 and 223 formed thereon. When the fixing flange sections 210 and 220 are engaged with each other, as shown in FIG. 5, a bolt and nut 230 and 231 are coupled through the fixing holes 213 and 214, and accordingly, the upper and lower casings 120 and 110 are fixedly coupled with each other. Here, the shape of the fixing flange sections 210 and 220 may be designed as the one shown in FIG. 5, or may be like the one shown in FIG. 6 in which the fixing flange sections 210 and 220 are engaged with each other by a rise which is inserted into a recession.

A lower flange section 410 is provided on the first side plate section 113 and first round corner 112 of the lower casing 110 and includes a first side flange portion 411 covering first side plate section 113, a first first corner flange portion 412 extended from first side flange section 411 and covering first round corner 112, a first plane 416 formed on first side flange portion 411, and a second plane 417 formed on first corner flange portion 412, first plane 416 and second plane 417 meeting at a first corner line 418 and being rectangular, while an upper flange section 420 is provided on the second side plate section 123 and second round corner 122 of the upper casing 120 and includes a second side flange portion 421 covering second side plate section 123, a second corner flange portion 422 extended from second side flange portion 421 and covering second round corner 122, a third plane 426 formed on second side flange portion 421, and a fourth plane 427 formed on second corner flange portion 422, third plane 426 and fourth plane 427 meeting at a second corner line 428 and being rectangular. The lower and upper flange sections 410 and 420 are disposed on the same line, which is vertically extended.

The lower and upper casings 110 and 120 are molded by injection molding. Here, the first and second side plate sections 113 and 123 and the lower and upper flange sections 410 and 420 are integrally injection-molded with the lower casing 110 and upper casing 120, respectively. In such a situation, in order to detach the injected lower and upper casings 110 and 120 from the mold, the first and second side plate sections 113 and 123 are curved.

Here, lower and upper outer plane sides 413 and 423 of the lower and upper flange sections 410 and 420 are not curved, but formed to be plane. Since the width of the lower and upper flange sections 410 and 420 is narrower than the width of the first and second side plate sections 113 and 123, the lower and upper plane sides 413 and 423 of the respective flange sections 410 and 420 do not affect the efficiency of injection molding.

The respective flange sections 410 and 420 have inner hollow portions 415 and 425 defined therein. Without the inner hollow portions 415 and 425, the thickness of the lower and upper flange sections 410 and 420 may be varied in accordance with the curved shape of the first and second side plate sections 113 and 123. Accordingly, when cooling the injected material after the injection molding, the lower and upper flange sections 410 and 420 may be constricted by different degrees so that the lower and upper plane sides 413 and 423 of the flange sections 410 and 420 may be curved or deformed. With the presence of the inner hollow portions 415 and 425, however, the thickness of the flange sections 410 and 420 are kept to a uniform degree, so that the lower and upper plane sides 413 and 423 of the lower and upper flange sections 410 and 420 may be kept plane after the injection molding.

Figure 7:
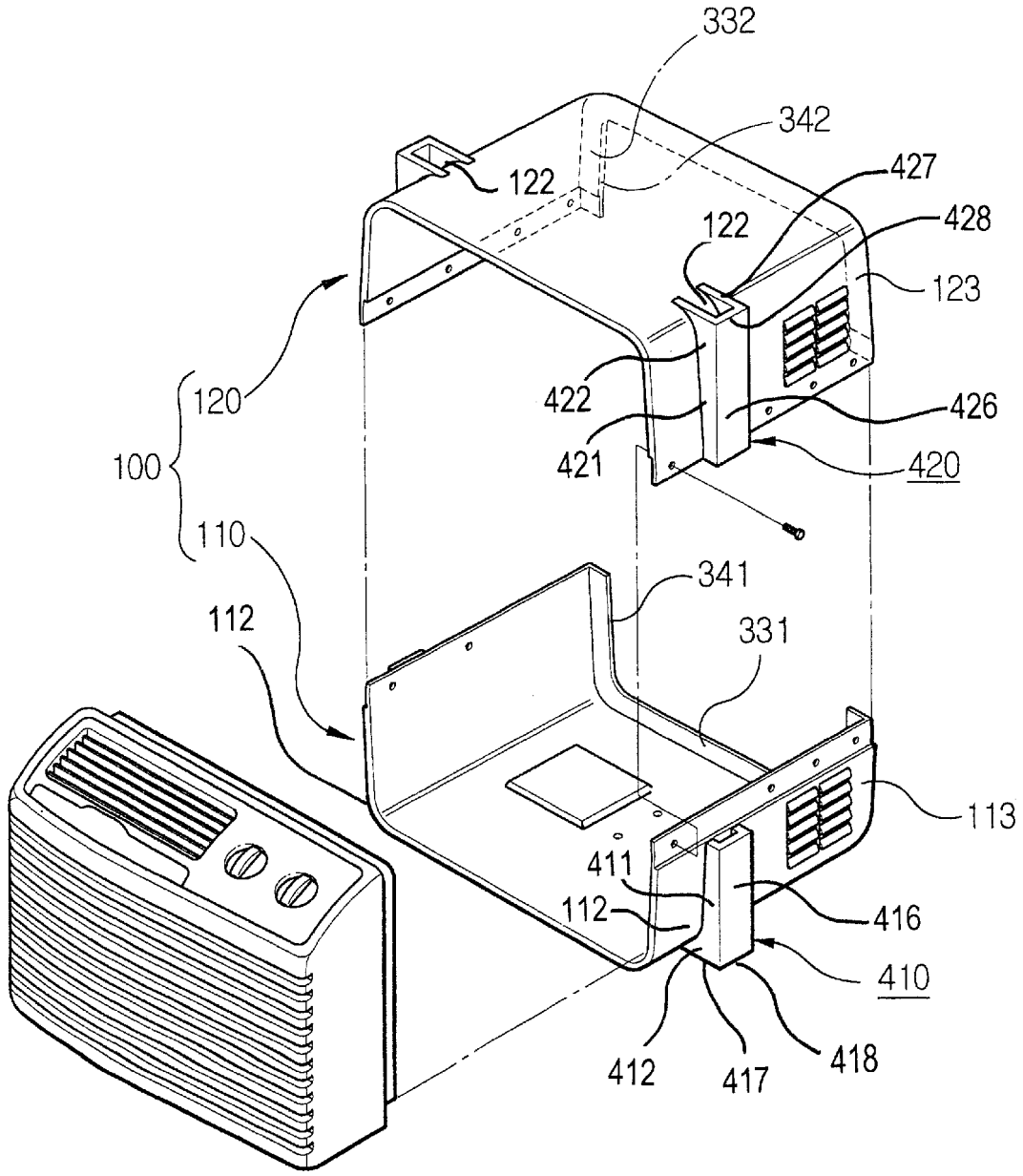
FIG.7 is an exploded perspective view of a window type air conditioner according to another embodiment of the present invention.

FIG. 7 is an exploded perspective view of a window type air conditioner according to another embodiment of the present invention. In FIG. 7, the parts which are installed on the lower casing 110 are omitted. In this embodiment, the lower and upper casings 110 and 120 further have rear plate sections 331 and 332 in addition to the first and second side plate sections 113 and 123. The rear plate sections 331 and 332 have exhaust outlets 341 and 342, respectively. Like the first and second side plate sections 113 and 123 and the lower and upper flange sections 410 and 420, the rear plate sections 331 and 332 are integrally formed with the lower and upper casings 110 and 120 by injection molding. Accordingly, there is no need to make the rear panel, separately, so that the manufacturing process becomes simpler.

Figure 8:
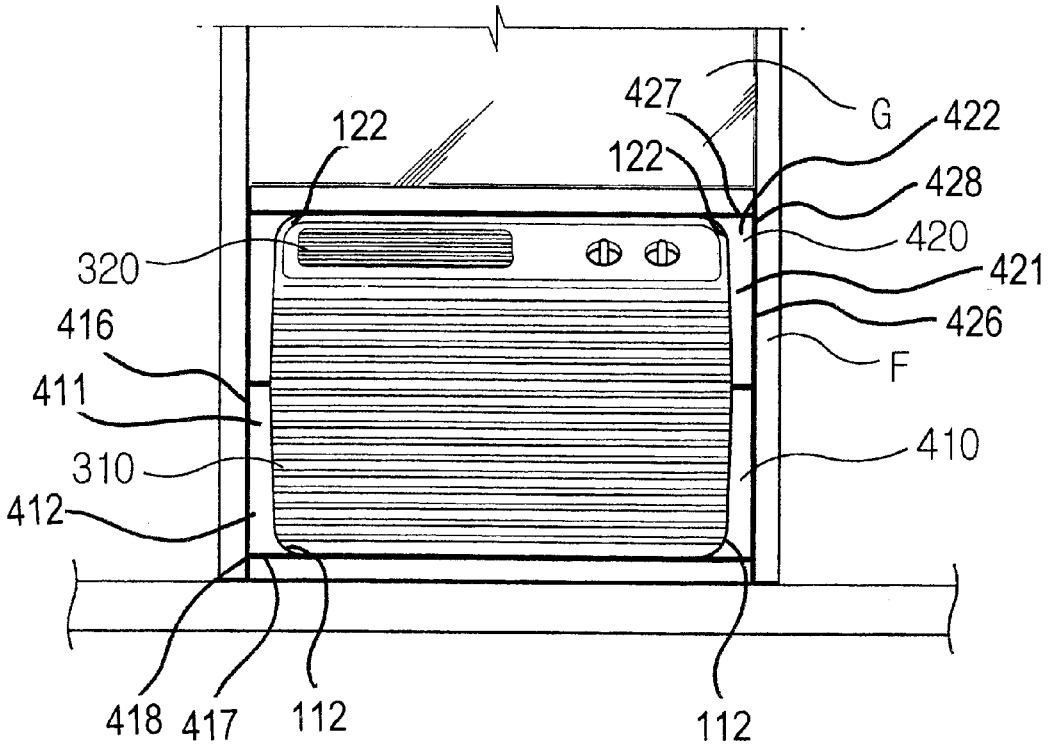
FIG. 8 is a front elevation of the window type air conditioner according to another embodiment of the present invention of FIG. 7 being installed.

FIG. 8 shows the window type air conditioner according to the present invention being installed through the window. The lower and upper plane sides 413 and 423 of the lower and upper flange sections 410 and 420 are formed to be plane, so that there is no gap defined between the flange sections 410 and 420 of the air conditioner and the frame F disposed around the window. Accordingly, there is no need to additionally employ separate sealing members to seal the gap.

Further, according to the present invention, the lower and upper flange sections 410 and 420 serve as reinforcement of the first and second side plate sections 113 and 123 of the lower and upper casings 110 and 120. Accordingly, the strength of both casings 110 and 120 is increased.

As described above, according to the present invention, since the casing is formed by injection molding, the manufacturing cost for the casing decreases while the manufacturing process becomes more efficient. Further, due to the presence of the lower and upper flange sections formed on the side of the casing, there is no gap defined between the air conditioner and the window during installation of the air conditioner. Accordingly, there is no need to additionally employ a separate sealing member. Further, since the lower and upper flange sections function to reinforce the strength of the casing, the strength of the casing is increased.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A window type air conditioner, comprising:

an injection-molded lower casing accommodating various parts of refrigerant cycle, having a bottom plate, first lower side plates, and first round corner portions each formed between said bottom plate and one of said lower side plates;

an injection-molded upper casing coupled to said lower side plates of said lower casing, having a top plate, two upper side plates, and second round corner portions each formed between said top plate and one of said upper side plates;

a pair of upper flanges each attached to outer surfaces of both one of said upper side plates and one of said second round corner portions of said upper casing; and a pair of lower flanges each attached to outer surfaces of both one of said lower side plates and one of said first round corner portions of said lower casing.

2. The air conditioner of claim 1, said upper and lower flanges comprising inner hollow portions formed inside said upper and lower flanges.

3. The air conditioner of claim 1, said upper and lower side plates of said lower and upper casing comprising air intake holes and air exhaust holes receiving outside air and exhausting inside air, respectively.

4. The air conditioner of claim 1, said upper flanges each comprising a corner flange portion covering one of said second round corner portions and a side flange portion covering one of said upper side plates.

5. The air conditioner of claim 4, said upper flanges each comprising:

a first plane formed on said corner flange portion and being parallel to said top plate; and a second plane formed on said side flange portion and being parallel to said one of said upper side plates.

6. The air conditioner of claim 1, said upper and lower flanges each comprising first and second planes, said first and second planes being rectangular.

7. The air conditioner of claim 1, said upper and lower flanges each comprising a corner flange portion and a side flange portion, said side flange portion engaged with one of said upper and lower side plates, said corner flange portion engaged with one of said first and second round corners and being thicker than said side flange portion.

8. The air conditioner of claim 1, said upper and lower flanges each comprising an inner hollow portion formed inside of each flange, said inner hollow portion having a corner hollow portion and a side hollow portion, said corner hollow portion being larger than said side hollow portion.

9. The air conditioner of claim 8, said inner hollow portion comprising an outer sidewall having a uniform thickness.

10. An air conditioner, comprising:

a lower casing;

an upper casing coupled to said lower casing, having a top plate, two upper side plates connected to said lower casing, and two round corners each formed between said top plate and each one of said upper side plates; and at least one flange attached to both one of said round corners and one of said upper side plates.

11. The air conditioner of claim 10, said flange comprising a round inner surface having the same shape as said round corners and attached to said one of said round corners of said upper casing.

12. The air conditioner of claim 10, said flange comprising a corner flange portion covering one of said round corners and a side flange portion covering one of said upper side plates.

13. The air conditioner of claim 12, said flange comprising a first plane formed on said corner flange portion and a second plane formed on said side flange portion, said first plane and second plane being rectangular.

14. The air conditioner of claim 13, said flange comprising said first plane parallel to said top plate.

15. The air conditioner of claim 10, said flange having a hollow formed inside of said flange along said flange.

16. The air conditioner of claim 10, said flange having a corner portion and a side portion, said corner portion being thicker than said side portion and comprising a round inner surface attached to one of said round corners of said upper casing.

17. The air conditioner of claim 10, said lower casing comprising:

a bottom plate;

two lower side plates each connected to said upper side plates of said upper casing;

two second round corners each formed between said bottom plate and each one of said lower side plate; and at least one second flange attached to one of said second round corners.

18. The air conditioner of claim 17, said second flange comprising a round inner surface attached to said one of said round corners.

19. The air conditioner of claim 17, said second flange comprising two outside planes being rectangular.

* * * * *